US006464432B1

(12) United States Patent
Shaw

(10) Patent No.: US 6,464,432 B1
(45) Date of Patent: Oct. 15, 2002

(54) INTERLOCKING SEGMENTAL RETAINING WALL

(75) Inventor: Kenneth L. Shaw, Colleyville, TX (US)

(73) Assignee: Shaw Technologies, Inc., Colleyville, TX (US)

( * ) Notice: Subject to any disclaimer, the term of this patent is extended or adjusted under 35 U.S.C. 154(b) by 0 days.

(21) Appl. No.: 09/502,587

(22) Filed: Feb. 11, 2000

Related U.S. Application Data

(60) Provisional application No. 60/119,833, filed on Feb. 12, 1999.

(51) Int. Cl.[7] ..... E02D 17/18; E04C 1/00

(52) U.S. Cl. ..... 405/286; 405/284; 52/604; 52/606; 52/608

(58) Field of Search ..... 405/284, 286, 405/16; 52/596, 604–609, 1

(56) References Cited

U.S. PATENT DOCUMENTS

| | | | | | |
|---|---|---|---|---|---|
| 4,964,761 | A | | 10/1990 | Rossi | 405/286 |
| 5,017,049 | A | | 5/1991 | Sievert | 405/284 |
| 5,062,610 | A | | 11/1991 | Woolford et al. | 249/52 |
| 5,145,288 | A | | 9/1992 | Borcherdt | 405/284 |
| 5,214,898 | A | | 6/1993 | Beretta | 52/606 |
| RE34,314 | E | * | 7/1993 | Forsberg | 52/562 |
| 5,294,216 | A | | 3/1994 | Sievert | 405/286 |
| 5,484,236 | A | | 1/1996 | Gravier | 405/286 |
| 5,589,124 | A | | 12/1996 | Woolford et al. | 264/157 |
| D380,560 | S | | 7/1997 | Forsberg | D25/113 |
| 5,653,558 | A | | 8/1997 | Price | 405/284 |
| D384,168 | S | | 9/1997 | Stevenson | D25/115 |
| 5,704,183 | A | * | 1/1998 | Woolford | 52/604 |
| 5,711,129 | A | * | 1/1998 | Woolford | 52/604 |
| 5,711,130 | A | | 1/1998 | Shatley | 52/604 |
| D397,451 | S | | 8/1998 | Stevenson | D25/115 |
| 5,827,015 | A | | 10/1998 | Woolford et al. | 405/286 |
| 5,865,006 | A | | 2/1999 | Dawson | 52/604 |
| 5,941,042 | A | * | 8/1999 | Dueck | 52/604 |
| 6,142,713 | A | | 11/2000 | Woolford et al. | 405/286 |
| 6,183,168 | B1 | | 2/2001 | Woolford et al. | 405/286 |
| 6,312,197 | B1 | | 11/2001 | Woolford et al. | 405/286 |
| 6,318,934 | B1 | | 11/2001 | Borgersen et al. | 405/262 |

FOREIGN PATENT DOCUMENTS

| | | |
|---|---|---|
| DE | 295 00 694 | 4/1995 |
| FR | 2 506 366 | 11/1982 |
| WO | WO 88/02050 | 3/1988 |
| WO | WO 01/00932 A1 | 1/2001 |

OTHER PUBLICATIONS

US 6,089,793, 7/2000, Rainey (withdrawn)*
International Search Report, PCT/US00/03677 (Jun. 13, 2000).

(List continued on next page.)

*Primary Examiner*—Thomas B. Will
*Assistant Examiner*—Tara L. Mayo
(74) *Attorney, Agent, or Firm*—Jenkens & Gilchrist

(57) ABSTRACT

An interlocking segmental retaining wall. The wall includes a plurality of blocks stacked upon each other. Each block includes a void filled with aggregate. In addition, each block includes an extension and slot for interlocking the blocks together to form the retaining wall. Each block also includes a plurality of lugs and an indentation for aligning and stacking the blocks on each other. The blocks may also be stacked to form a curved retaining wall. In an alternate embodiment, the blocks may have tabs located on an upper portion of each block. Each block is laterally positioned by centering the block upon the top of two lower blocks.

29 Claims, 5 Drawing Sheets

OTHER PUBLICATIONS

Keystone Retaining Wall Systems, Inc., "Keystone Sets the Standard", Copyright 1997.

Pacific Precast Products, Ltd., "The Great Wall", Copyright 1998.

Pavestone Co., Pavestone Guide to Decorative Landscape projects, "Walls and Raised Planters" and "Grade Changes and Steps", Copyright 1996 (6/96), pp. 24–28 and 32–34.

Risi Stone Systems, Pisa II Retaining Wall System, Copyright 1994 (02276/RIS).

Risi Stone Systems, Risi Stone Retaining Wall Systems, Copyright 1993 (02276/RIS).

Risi Stone Ltd., Precast Concrete Retaining Walls, Copyright 1988 (02276/RIS).

* cited by examiner

INTERLOCKING SEGMENTAL RETAINING WALL

PRIORITY STATEMENT UNDER 35 U.S.C. §119(E) & 37 C.F.R. §1.78

This nonprovisional application claims priority based upon the prior U.S. provisional application entitled, "Improved Interlocking Segmental Retaining Wall", application Ser. No. 60/119,853, filed Feb. 12, 1999, in the name of Larry Shaw.

BACKGROUND OF THE INVENTION

1. Technical Field of the Invention

This invention relates to retaining walls and, more particularly, to an interlocking segmental retaining wall.

2. Description of Related Art

Retaining walls having been used in landscaping and construction for many years. Retaining walls are used to support or retain soil, or its equivalent, in place. Retaining walls are also used to enhance the appearance of the surrounding area.

Retaining walls are constructed in many different ways. For example, wooden beams may be utilized. However, one of the most popular, and aesthetically pleasing forms of constructing a retaining wall involves the use of segmental blocks. The blocks may be stacked one on top of the other to form a pattern on an outside face of the retaining wall. It can be very time consuming and tedious aligning numerous blocks to form the proper pattern in the retaining wall. In addition, designers of retaining walls are constantly striving to construct retaining walls providing greater strength to support a greater weight. A retaining wall is needed which provides enhanced structural support and is simple and inexpensive to manufacture.

Although there are no known prior art teachings of a solution to the aforementioned deficiency and shortcoming such as that disclosed herein, prior art references that discuss subject matter that bears some relation to matters discussed herein are U.S. Pat. No. 4,964,761 to Rossi (Rossi), U.S. Pat. No. 5,145,288 to Borcherdt (Borcherdt), U.S. Pat. No. 5,214,898 to Beretta (Beretta), and U.S. Pat. No. 5,294,216 to Sievert (Sievert).

Rossi discloses dry-mounted construction elements for use in a retaining wall. Each element has a bottomless container having vertical partitions that are disposed to delimit a large front space which serves as a flower pot, and at least two smaller rear spaces which serve as root cavities. The construction has a rear portion which has a notch disposed on each upper side edge of the container, and two small cavities or spaces behind the notches. The elements may be stacked in a vertical offset by placing an extension on a top element into a slot on a bottom element. Although Rossi discloses a plurality of notches for aligning and stacking the blocks on each other, when the blocks are used in a curved wall, there are gaps between the blocks at the front of the wall, which is a serious disadvantage. Additionally, Rossi discloses a complicated series of openings within each block, which can be very costly to manufacture.

Borcherdt discloses a retaining wall constructed from conventional concrete building blocks. A sheet member having protrusions is used to align and interlock the building blocks together. The sheet member may be used as a tie-back, such as for anchoring the retaining wall to backfill material. However, Borcherdt does not teach or suggest a plurality of lugs and indentations for aligning the blocks. Borcherdt merely discloses utilizing a sheet member for aligning and interlocking the blocks together. Additionally, Borcherdt does not teach or suggest stacking the blocks in a vertical offset, which is necessary to increase the overall strength of the retaining wall.

Beretta discloses a retaining wall having a series of blocks. Each block has a cambered front with tapering side walls. Each side wall has a portion radiused to the front, with mutually opposite insertion-coupling members and seats for interlocking with an adjacent block. Additionally, each block has an abutment on an upper portion of the block for engagement with a supporting element defined on a lower part at the front of an adjacent block. However, Beretta does not teach or suggest interlocking and stacking the blocks in a vertical offset, which would be advantageous in providing a stronger retaining wall.

Sievert discloses a retaining wall having a plurality of composite masonry blocks. Each block has a block body having an irregular trapezoidal shape. The block has a front surface, a back surface, an upper surface, a lower surface and a first and second sidewall. Each sidewall has a first and second part. The first part of the sidewall extends from the block front surface towards the block back surface at an angle of no greater than ninety degrees in relationship to the block front surface. The sidewall second part adjoins and lies between the first part and the block back surface. In addition, the block also has a flange extending from the block back surface past the height of the block. However, Sievert does not disclose a block having a void. Additionally, Sievert does not teach or suggest utilizing an extension and slot for interlocking and stacking the blocks in a vertical offset.

Thus, it would be a distinct advantage to have a retaining wall which is simple to construct and which provides greater support, while maintaining the aesthetic beauty of the segmental block pattern. It is an object of the present invention to provide such a retaining wall.

SUMMARY OF THE INVENTION

In one aspect, the present invention is an interlocking segmental retaining wall having at least a first row and a second upper row resting on top of the first row. Each of the rows includes one or more blocks. Each of the blocks includes a block body having a front wall, a back wall, a first side wall, and a second side wall forming a void within an interior area of the block. The walls have an upper surface and a lower surface. Each block also includes a plurality of lugs located on the lower surface of the block adjacent to the void and a lug indentation located on the upper surface of the block adjacent to the void. The lug indentation is sized to accommodate at least one lug from an upper block of the second row. Each block also includes an extension located on a bottom portion of the back wall of the block and a slot located on an upper portion of the back wall of the block. The slot provides a support for the extension of an upper block from the upper row of the retaining wall to rest. When stacking the blocks on top of each other, a lug from the upper block is inserted into the lug indentation of the lower block and the extension of the upper block rests on the slot of the lower block.

In another aspect, the present invention is an interlocking segmental retaining wall having at least a first row and a second upper row resting on top of the first row. Each of the rows includes one or more blocks. Each of the blocks includes a block body having a front wall, a back wall, a first side wall, and a second side wall forming a void within an interior area of the block. The walls have an upper surface and a lower surface. Each block also includes a plurality of tabs located on the upper surface of the back wall adjacent to the void. The plurality of tabs are vertically extended from the upper surface of the back wall. Each upper block is positioned on top of a lower block of the first row by positioning a tab of the lower block within the void of the upper block against a lower inner side of the back wall adjacent the void.

In still another aspect, the present is an interlocking segmental retaining wall. The wall includes a first row of segment blocks with a plurality of lower segment blocks. Each of the lower segment blocks includes a left side wall, a right side wall, a front wall, and a rear wall, forming a central void in each block. Each of the walls has an upper surface. The rear wall also has a lateral slot in an upper rear portion forming a cutout step at the back of the block and a lug indentation located on a front side of the upper surface of the rear wall adjacent to the void and laterally centered between the left side wall and the right side wall. The wall also includes a second row of segment blocks having a plurality of upper segment blocks. Each of the upper segment blocks includes a left side wall, a right side wall, a front wall, and a rear wall, forming a central void in each block. Each of the walls has a lower surface. The rear wall includes an extension that extends downward at the back of the block beyond the lower surfaces of the front and side walls. The rear wall also includes first and second lugs located on a front side of the lower surface of the rear wall adjacent to the void at the right and left edges of the void. An upper block is laterally centered over two lower blocks by placing one of the lugs of the upper block in the lug indentation of a lower block.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF THE INVENTION

The present invention is an interlocking segmental retaining wall.

Figure 1:
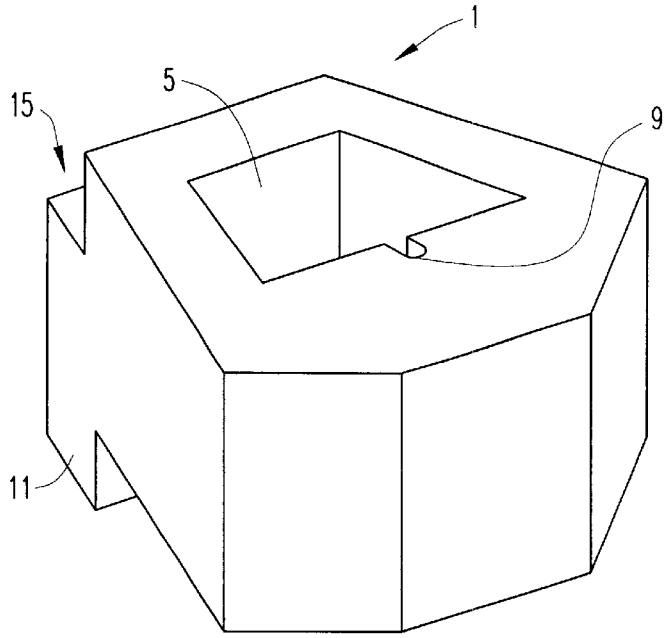
FIG. 1 is a perspective view illustrating a segment block in a first embodiment of the present invention.
Figure 5:
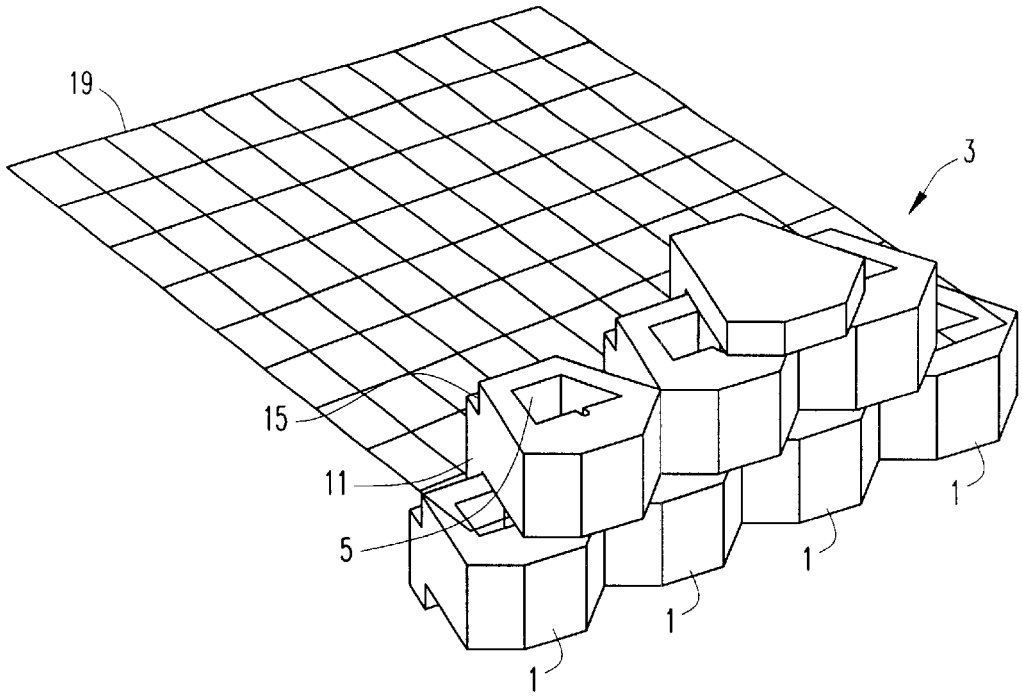
FIG. 5 is a perspective view of a retaining wall which utilizes a plurality of blocks according to the teachings of the present invention.

FIG. 1 is a perspective view illustrating a segment block 1 in a first embodiment of the present invention. The block is used in the construction of an interlocking segmental retaining wall 3 (FIG. 5). The block is typically constructed of some rigid material, such as concrete or brick. The block includes a void 5 within an interior portion of the block. In the preferred embodiment, the void is located within the center of the block 1.

Figure 2:
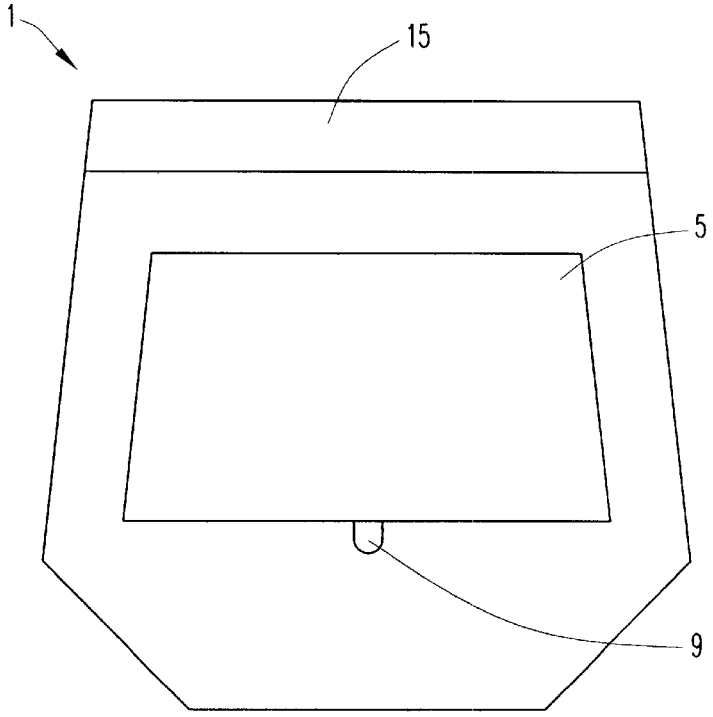
FIG. 2 is a top plan view of the segment block of FIG. 1.

FIG. 2 is a top plan view of the segment block 1 of FIG. 1. The block includes a plurality of lugs 7, located on the outer edges of the void 5. The lugs 7 are outcroppings of the block used for aligning the segment block with another block. An indentation 9 is located on an outer center edge of the void 5. The indentation provides an area for placement of the plurality of the lugs 7 of adjacent blocks stacked on top of the block and horizontally offset. The indentation can accommodate one or more lugs.

Figure 3:
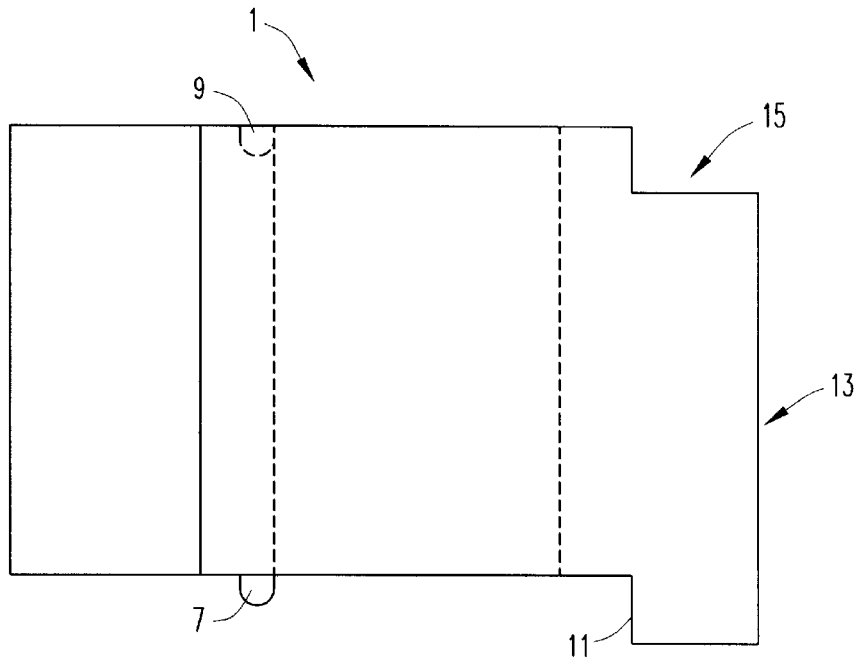
FIG. 3 is a side elevational view of the segment block of FIG. 1.

FIG. 3 is a side view of the segment block 1 of FIG. 1. The block includes an extension 11 located on a bottom portion of a back wall side 13 of the block. The extension 11 is an outcropping of the block. In addition, the block includes a slot 15, located on a top portion of the back wall side 13 of the block. The width of the slot 15 is narrower than the width of the extension 11.

Figure 4:
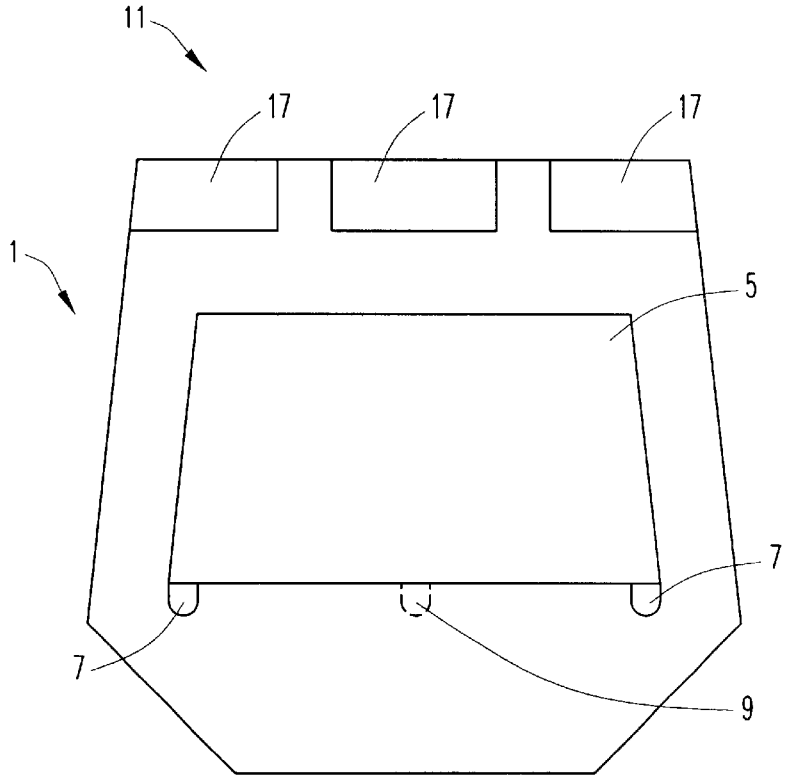
FIG. 4 is a bottom plan view of the segment block of FIG. 1.

FIG. 4 is a bottom plan view of the segment block 1 of FIG. 1. The extension 11 is divided into a plurality of tabs 17. The tabs may be removed when constructing a curved retaining wall (discussed below).

FIG. 5 is a perspective view of the retaining wall 3 utilizing a plurality of blocks 1 according to the teachings of the present invention. Referring to FIGS. 1–5, the structure of the retaining wall 3 will now be explained. The blocks are stacked one on top of another. However, as illustrated in FIG. 5, the placement of a block is centered upon the top of two lower blocks, by staggering the top block one half unit. By staggering the blocks, a running bond pattern can be achieved, which provides an appealing design. The alignment of the blocks is achieved by locating the lugs 7 of an upper block with the indentation 9 of a lower block.

The extension 11 of an upper block is placed upon the slot 15 of a lower block. Since the extension is wider than the slot, when the blocks are stacked, a vertical offset is achieved. This offset increases the overall stability and strength of the wall. Additionally, the extensions and slots provides an interlocking means between the blocks, allowing a greater strength in the retaining wall 3.

A geo-grid 19 may be placed between each layer of blocks. The geo-grid is commonly used in retaining walls to provide additional support to the retaining wall 3. However, with the addition of the slots 15 and the extensions 11, an increased frictional coefficient is achieved between the geo-grid and the blocks, which provides a stronger support for the retaining wall. Aggregate may be placed within each void 5 of the blocks, again enhancing the overall strength of the retaining wall.

The tabs 17 allow the retaining wall 3 to be curved, if desired. In order to provide a curved shape to the retaining wall, the outer tabs 17 of each block are removed. Additionally, the lugs 7 of each corresponding block are removed. This allows the blocks to be stacked at an angle.

The retaining wall 3 provides both increased strength as well as a pleasing appearance. In addition, the construction of the wall is simplified by the lugs and indentation on the blocks.

Figure 6:
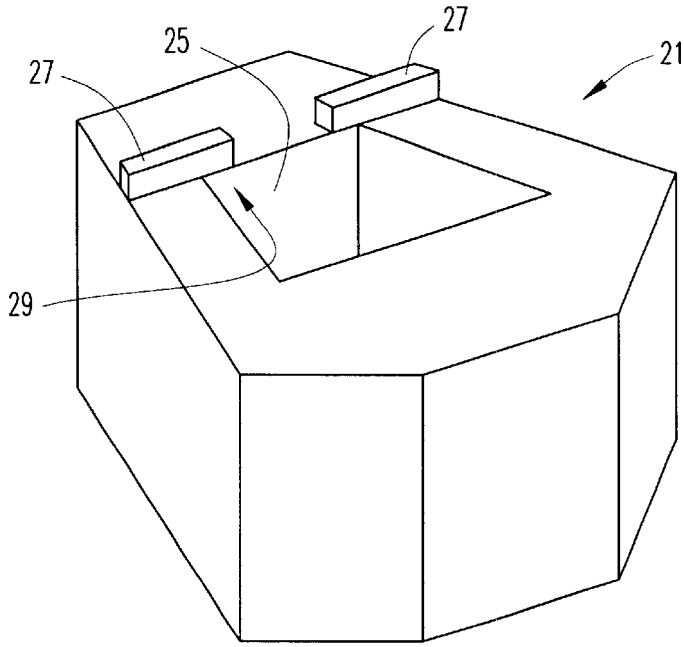
FIG. 6 is a perspective view of an alternate embodiment of a retaining wall block.

FIG. 6 is a perspective view illustrating a block 21 in an alternative embodiment of the present invention. The block 21 is used in the construction of a retaining wall 23 (FIG. 10). The block 21 is constructed of a similar material as the block 1. The block 21 includes a void 25 within an interior portion of the block.

Figure 7:
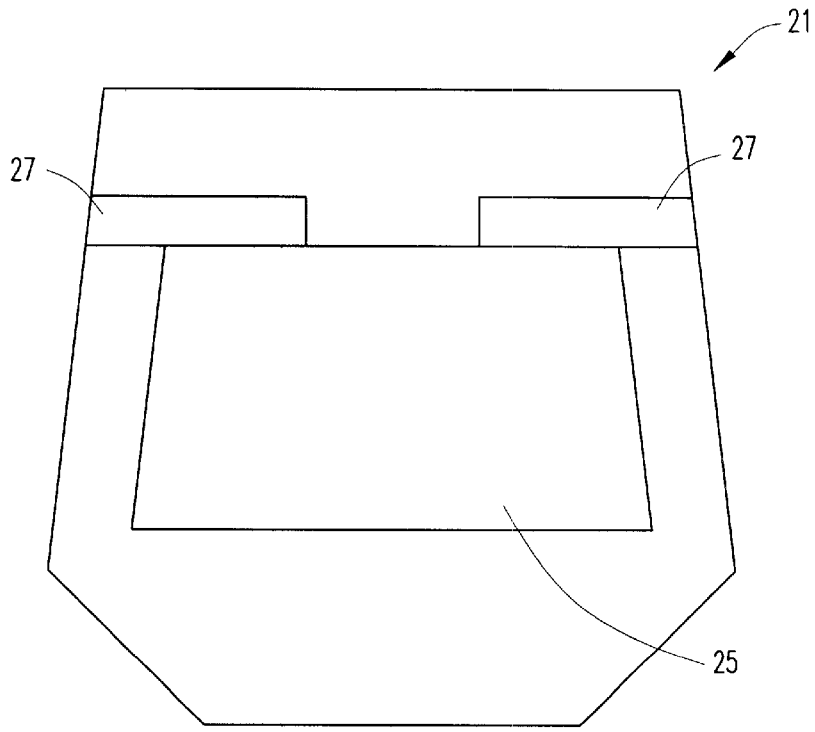
FIG. 7 is a top plan view of the block of FIG. 6.

FIG. 7 is a top plan view of the block 21 of FIG. 6. The block 21 does not have any lugs or indentations as described for block 1, but includes a plurality of upper tabs 27 located on a top portion of a back inner wall side 29 adjacent the void 25. The tabs are outcroppings of the block. Although two tabs are illustrated, any number of tabs may be utilized.

Figure 8:
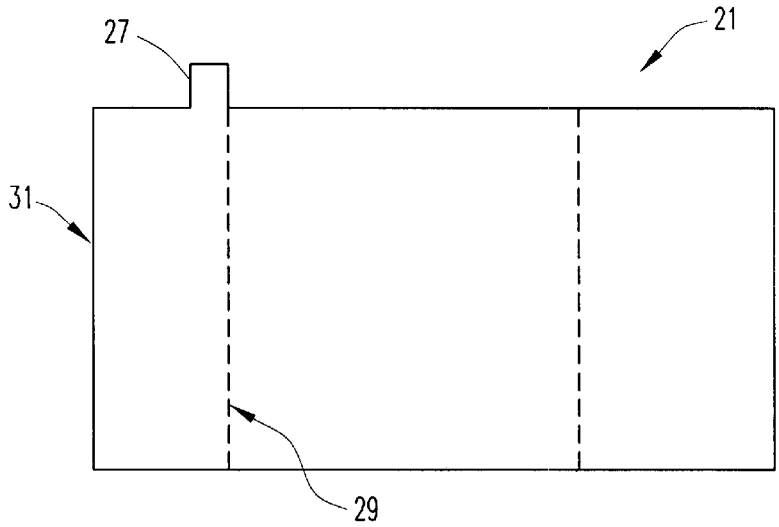
FIG. 8 is a right side elevational view of the block of FIG. 6.

FIG. 8 is a right side elevational view of the block 21 of FIG. 6. Unlike the block 1, the block 21 does not have a slot 15 at the top rear corner of the block.

Figure 9:
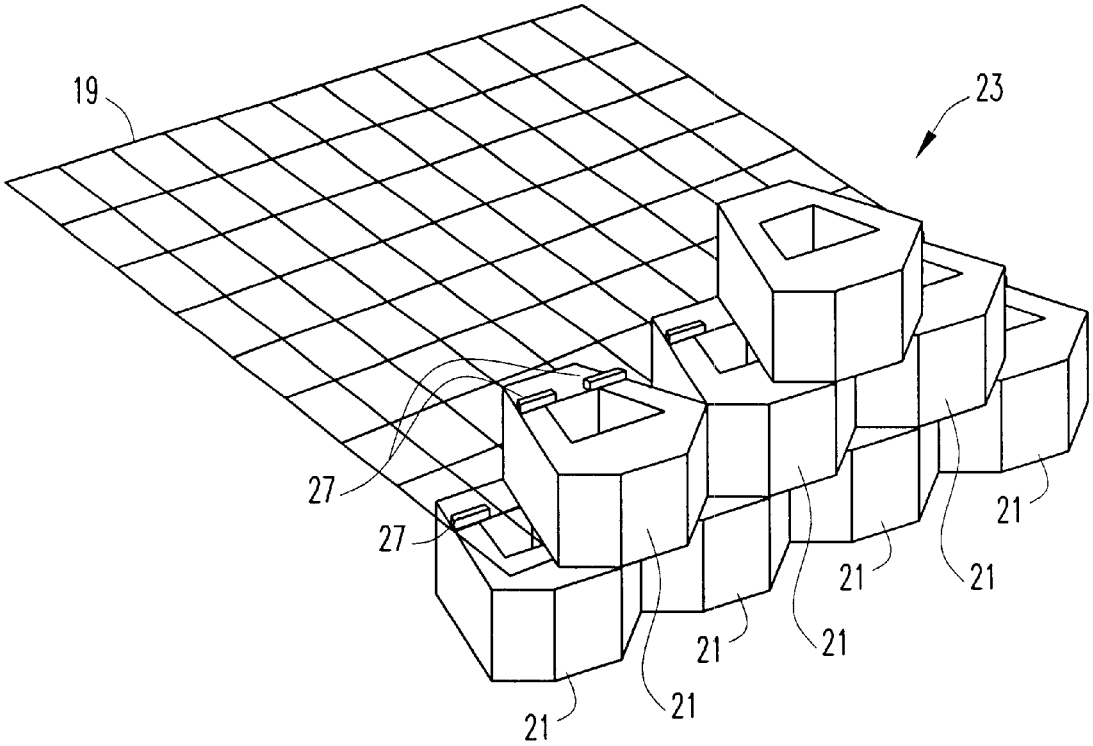
FIG. 9 is a perspective view of a retaining wall which utilizes a plurality of blocks in an alternative embodiment of the present invention.

FIG. 9 is a perspective view of the retaining wall 23 utilizing a plurality of blocks 21 in an alternate embodiment of the present invention. Referring to FIGS. 6–10, the structure of the retaining wall will now be explained. The blocks are stacked one on top of another. However, as illustrated in FIG. 10, the lateral placement of each block is centered upon the top of two lower blocks, by staggering the top block one half-unit to the right or left. The lateral alignment of the blocks is achieved by aligning one of the upper tabs 27 of a lower block within the void 25, and against the back inner wall side 29, of an upper block positioned on top of the lower block. Each adjacent block can be similar positioned to achieve the desired pattern achieved for the retaining wall 3 illustrated in FIG. 5.

The positioning of the back inner wall side 29 of a upper block 21 against one of the upper tabs 27 of a lower block creates a vertical offset. As discussed for the retaining wall 3, the offset increases the overall stability and strength of the wall. Additional, the geo-grid 19 may be utilized between each layer of blocks in a similar manner as discussed above. Aggregate may also be placed within each void 25, thereby increasing the overall strength of the retaining wall 23.

It is thus believed that the operation and construction of the present invention will be apparent from the foregoing description. While the apparatus shown and described has been characterized as being preferred, it will be readily apparent that various changes and modifications could be made therein without departing from the scope of the invention as defined in the following claims.

What is claimed is:

1. A retaining wall having at least a first row and a second upper row resting on top of the first row, each of said rows comprising one or more blocks, each of said blocks comprising:

a block body having:

a front wall, a back wall, a first side wall, and a second side wall forming a void within an interior area of the block, said walls having an upper surface and a lower surface;

a plurality of lugs located on the lower surface of the block adjacent to the void;

a lug indentation located on the upper surface of the block adjacent to the void, said lug indentation sized to accommodate at least one lug from an upper block of the second row, an extension located on a bottom portion of the back wall of the block; and a slot located on an upper portion of the back wall of the block, the slot providing a support for the extension of an upper block from the upper row of the retaining wall to rest;

whereby a lug from the upper block is inserted into the lug indentation of the lower block, the extension of the upper block resting on the slot of the lower block.

2. The retaining wall of claim 1 wherein the plurality of lugs of each block are located on the front wall adjacent the void.

3. The retaining wall of claim 1 wherein the lug indentation of each block is located between the plurality of lugs, thereby horizontally offsetting the upper row of blocks from the first row of blocks.

4. The retaining wall of claim 1 wherein the extension of each block includes a plurality of break-away tabs, whereby some of the tabs may be removed to provide a curvature to the retaining wall.

5. The retaining wall of claim 1 wherein a width of the extension of each block is wider than a width of the slot of each block, thereby providing a vertical offset when the upper row of blocks is stacked on top of the first row of blocks.

6. The retaining wall of claim 1 wherein the void is filled with an aggregate material.

7. The retaining wall of claim 1 further comprising a geo-grid located between each row of blocks.

8. A retaining wall having at least a first row and a second upper row resting on top of the first row, each of said rows comprising one or more blocks, each of said blocks comprising:

a block body having:

a front wall, a back wall, a first side wall, and a second side wall forming a void within an interior area of the block, said walls having an upper surface and a lower surface; and a plurality of tabs located on the upper surface of the back wall of the block adjacent to the void, said plurality of tabs vertically extending out from the upper surface of the back wall;

whereby at least one of said upper blocks from the upper row is positioned on top of a lower block of the first row, a tab of the lower block being positioned within the void of the at least one upper block against a lower inner side of the back wall adjacent the void and whereby said at least one of said upper blocks from the upper row is positioned on top of a second lower block of the first row, a tab of said second lower block being positioned within the same void of said at least one upper block.

9. The retaining wall of claim 8 wherein each tab is positioned from the upper surface of the back wall and runs across a portion of the upper surface of each side wall.

10. The retaining wall of claim 8 further comprising a geo-grid located between each row of blocks.

11. The retaining wall of claim 8 wherein each upper block is laterally positioned on top of the first row by centering the upper block upon two lower blocks in the first row.

12. The retaining wall of claim 8, said tabs comprising substantially rectangular outcroppings of the block.

13. The retaining wall of claim 8, said tabs comprising elongated outcroppings of the block, each tab having at least one side, wherein said at least one side is adjacent to the void.

14. The retaining wall of claim 13, wherein a tab of said plurality of tabs of each of two adjacent blocks of said first row are positioned within said void formed within the interior area of the blocks of the second row.

15. The retaining wall of claim 8, wherein said void within the interior area of said blocks is generally central.

16. The retaining wall of claim 8, said plurality of tabs comprising a left-side tab and a right-side tab;

wherein each upper block is laterally positioned on top of a left lower block and a right lower block of the first row in a staggered relationship to position the void formed in said upper block over the left-side tab of said right lower block and the right-side tab of said left lower block.

17. An interlocking segmental retaining wall comprising:

a first row of segment blocks comprising a plurality of lower segment blocks, each of said lower segment blocks comprising:

a left side wall, a right side wall, a front wall, and a rear wall, forming a central void in each block, each of the walls having an upper surface, and said rear wall having a lateral slot in an upper rear portion thereof forming a cutout step at the back of the block, and a lug indentation located on a front side of the upper surface of the rear wall adjacent to the void and laterally centered between the left side wall and the right side wall; and a second row of segment blocks comprising a plurality of upper segment blocks, each of said upper segment blocks comprising:

a left side wall, a right side wall, a front wall, and a rear wall, forming a central void in each block, each of the walls having a lower surface, and said rear wall including:

an extension that extends downward at the back of the block beyond the lower surfaces of the front and side walls; and first and second lugs located on a front side of the lower surface of the rear wall adjacent to the void at the right and left edges of the void;

whereby an upper block is laterally centered over two lower blocks by placing one of the lugs of the upper block in the lug indentation of a lower block.

18. The interlocking segmental retaining wall of claim 17 wherein the lug indentation is sized to accommodate two lugs from adjacent upper segment blocks.

19. The interlocking segmental retaining wall of claim 17 wherein the extension of the rear wall of the upper block has a fore and aft thickness that is greater than a fore and aft width of the lateral slot in the lower block, thus creating a vertical offset when the extension is placed in the slot.

20. An interlocking retaining wall block comprising:

a body having a front wall forming a front of the block and a back wall forming a back of the block, and a left and a right sidewall;

wherein said front and back walls are connected by said left and right side walls, and said four walls define a void extending through the block;

said back wall comprising an upper surface, and an inner side adjacent the void;

a right-side outcropping and a left-side outcropping of the block extending vertically from the upper surface of the back wall; and each of said outcroppings having a front side immediately adjacent to the edge of said void;

wherein said interlocking block is adapted to be laterally positionable in a staggered relationship above adjacent left and right underlying interlocking retaining wall blocks, each of said left and right underlying interlocking retaining wall blocks having a right-side outcropping and a left-side outcropping; and wherein said inner side of the back wall adjacent the void is adapted for engagement with the left-side outcropping of said right underlying interlocking block and said right-side outcropping of said left underlying interlocking block.

21. The interlocking block of claim 20, said outcroppings being substantially rectangular.

22. The interlocking block of claim 20, wherein the void extending through the block is generally central.

23. The interlocking block of claim 20, wherein said interlocking block is adapted to comprise a segment of a vertically offset retaining wall, having a running bond pattern.

24. A method of constructing a retaining wall, of the type wherein a plurality of interlocking blocks are assembled together, said interlocking blocks each having a body including front and back walls, left and right sidewalls connecting said front and back walls, said four walls defining a void extending through the block, and a plurality of elongated block outcroppings extending vertically from an upper surface of the back wall of the body, comprising the steps of:

assembling from ones of said plurality of interlocking blocks a first row of adjacent blocks; and stacking from ones of said plurality of interlocking blocks a second row of adjacent blocks on top of said first row; said stacking step comprising:

staggering the blocks of the second row one half-unit laterally to position said void of each said second-row block over at least one outcropping of each of two adjacent blocks of the first row; and positioning the back walls of the blocks of the second row against said outcroppings over which said void is positioned.

25. The method of claim 24, the step of positioning the back walls of the blocks of the second row against said outcroppings further comprising the step of positioning the outcroppings against a back inner side of the back wall.

26. The method of claim 24, wherein each outcropping includes a front side contacting said void of its respective block;

said step of stacking further comprises the step of forming a vertically-offset retaining wall.

27. The method of claim 24, wherein said plurality of elongated outcroppings includes one left and one right outcropping, and the void defined by said walls is located in a central area of the block.

28. The method of claim 24, further comprising the step of placing a geo-grid between the first and second rows of interlocking blocks.

29. A retaining wall having at least a first row and a second upper row resting on top of the first row, each of said rows comprising one or more blocks, each of said blocks comprising:

a block body having:

a front wall, a back wall, a first side wall, and a second side wall forming a void within an interior area of the block, said walls having an upper surface and a lower surface; and a plurality of tabs located on the upper surface of the back wall of the block adjacent to the void, said plurality of tabs vertically extending out from the upper surface of the back wall;

whereby each upper block from the upper row is positioned on top of a lower block of the first row, a tab of the lower block being positioned within the void of the upper block against a lower inner side of the back wall adjacent the void;

said tabs comprising elongated outcroppings of the block, each tab having at least one side, wherein said at least one side is adjacent to the void;

wherein a tab of said plurality of tabs of each of two adjacent blocks of said first row are positioned within said void formed within the interior area of the blocks of the second row.

* * * * *

UNITED STATES PATENT AND TRADEMARK OFFICE

CERTIFICATE OF CORRECTION

PATENT NO. : 6,464,432 B1
DATED : October 15, 2002
INVENTOR(S) : Kenneth L. Shaw It is certified that error appears in the above-identified patent and that said Letters Patent is hereby corrected as shown below:

Column 1,
Line 9, replace "Ser. No. 60/119,853," with -- Ser. No. 60/119,833, --

Signed and Sealed this

Fifteenth Day of July, 2003

JAMES E. ROGAN
*Director of the United States Patent and Trademark Office*